US009726104B2

(12) United States Patent
Tokuo et al.

(10) Patent No.: US 9,726,104 B2
(45) Date of Patent: Aug. 8, 2017

(54) CONTROL METHOD OF MAGNETIC SOLENOID VALVE, CONTROL METHOD OF ELECTROMAGNETICALLY CONTROLLED INLET VALVE OF HIGH PRESSURE FUEL PUMP, AND CONTROL DEVICE FOR ELECTROMAGNETIC ACTUATOR OF ELECTROMAGNETICALLY CONTROLLED INLET VALVE

(75) Inventors: Kenichiro Tokuo, Hitachinaka (JP); Satoshi Usui, Hitachinaka (JP); Masayuki Suganami, Iwaki (JP); Shunsuke Aritomi, Mito (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 393 days.

(21) Appl. No.: 13/562,997

(22) Filed: Jul. 31, 2012

(65) Prior Publication Data

US 2013/0032212 A1 Feb. 7, 2013

(30) Foreign Application Priority Data

Aug. 3, 2011 (JP) ..... 2011-169741

(51) Int. Cl.
*F02D 41/30* (2006.01)
*F04B 7/00* (2006.01)
(Continued)

(52) U.S. Cl.
CPC ..... *F02D 41/3082* (2013.01); *F02D 41/20* (2013.01); *F04B 7/0053* (2013.01);
(Continued)

(58) Field of Classification Search
CPC ..... F04B 49/065; F04B 7/065; F04B 17/05; F04B 49/22; F04B 49/243; F16K 31/02;
(Continued)

(56) References Cited

U.S. PATENT DOCUMENTS 5,917,692 A * 6/1999 Schmitz et al. ..... 361/187
5,959,825 A * 9/1999 Harcombe ..... 361/154
(Continued)

FOREIGN PATENT DOCUMENTS

DE WO 2010079027 A1 * 7/2010 ..... F02D 41/20
JP 2003-161226 A 6/2003
(Continued)

*Primary Examiner* — Alexander Comley
(74) *Attorney, Agent, or Firm* — Foley & Lardner LLP

(57) ABSTRACT

In an electromagnetically controlled inlet valve actuator provided to a high pressure fuel pump, an impinging sound which is generated at the time of operating the mechanism is reduced. In a high pressure fuel pump provided with an electromagnetically controlled inlet valve (operated by way of a plunger rod), a current supply period includes a 1st current supply period for performing an operation of attracting the plunger rod in a valve closing direction, a 2nd current supply period for alleviating a speed at which the plunger rod moves in a valve opening direction, and a limited current supply period disposed between the 1st current supply period and the 2nd current supply period in the form of spanning a pump top dead center.

18 Claims, 10 Drawing Sheets

(51) Int. Cl.

| | |
|---|---|
| ***F04B 49/06*** | (2006.01) |
| ***F02D 41/20*** | (2006.01) |
| *F04B 49/24* | (2006.01) |
| *F04B 17/05* | (2006.01) |

(52) U.S. Cl.
CPC .... *F04B 49/065* (2013.01); *F02D 2041/2027* (2013.01); *F02D 2041/2037* (2013.01); *F02D 2041/2058* (2013.01); *F04B 17/05* (2013.01); *F04B 49/243* (2013.01); *Y10T 137/0318* (2015.04)

(58) Field of Classification Search
CPC ..... F02M 59/368; F02D 41/2037; F02D 41/3082; F02D 2041/3845
USPC ..... 123/495, 458
See application file for complete search history.

(56) References Cited

U.S. PATENT DOCUMENTS

| | | | | |
|---|---|---|---|---|
| 6,394,414 | B1 * | 5/2002 | Breitling et al. | 251/129.04 |
| 6,483,689 | B1 * | 11/2002 | Koch et al. | 361/160 |
| 7,240,666 | B2 * | 7/2007 | Okamoto | 123/446 |
| 7,299,790 | B2 * | 11/2007 | Okamoto | F02D 41/3845 123/446 |
| 2004/0055580 | A1 * | 3/2004 | Yamada et al. | 123/495 |
| 2009/0301439 | A1 * | 12/2009 | Suzuki et al. | 123/458 |
| 2009/0301441 | A1 * | 12/2009 | Hasegawa et al. | 123/476 |
| 2011/0217837 | A1 | 9/2011 | Kuratani et al. | |

FOREIGN PATENT DOCUMENTS

| | | | | |
|---|---|---|---|---|
| JP | 2003161226 | A * | 6/2003 | F02M 59/44 |
| JP | 2009-203987 | A | 9/2009 | |
| JP | 2010-014109 | A | 1/2010 | |
| JP | 2011-181825 | A | 9/2011 | |

* cited by examiner

VIEW AS VIEWED IN THE DIRECTION INDICATED BY AN ARROW P (PRIOR AIRT)

CONTROL METHOD OF MAGNETIC SOLENOID VALVE, CONTROL METHOD OF ELECTROMAGNETICALLY CONTROLLED INLET VALVE OF HIGH PRESSURE FUEL PUMP, AND CONTROL DEVICE FOR ELECTROMAGNETIC ACTUATOR OF ELECTROMAGNETICALLY CONTROLLED INLET VALVE

CROSS-REFERENCE TO RELATED PATENT APPLICATIONS

Japan Priority Application 2011-169741, filed Aug. 3, 2011 including the specification, drawings, claims and abstract, is incorporated herein by reference in its entirety.

BACKGROUND OF THE INVENTION

1. Field of the Invention

The present invention relates to a control method of a magnetic solenoid valve used in an electromagnetically controlled inlet valve which adjusts a discharge amount of fuel by adjusting an amount of fuel which is discharged (spilled) from an inlet passage out of fuel sucked into a high pressure fuel pump, a control method of an electromagnetically controlled inlet valve of a high pressure fuel pump which includes a magnetic solenoid valve driven by the method as an inlet valve, and a control device of an electromagnetic actuator of an electromagnetically controlled inlet valve.

2. Description of the Related Art

As a related art pertaining to the field of the present invention, there has been known a device described in JP-A-2009-203987 (patent document 1). In this publication, there is the description that an amount of fuel which is fed under high pressure from a high pressure fuel pump is adjusted by controlling ON (energization) timing of electricity to a solenoid of a magnetic solenoid valve. To be more specific, when the solenoid is turned on (energized) in the midst of a compression stroke (phase) by a piston plunger of a high pressure fuel pump, a plunger rod is separated and moved from an inlet valve so that the inlet valve is moved to a valve closed position due to a force of a spring and a pressure of pressurized fuel. After the inlet valve is closed, the high-pressure feeding of fuel starts. A pressure in a pressurizing chamber is high during high-pressure feeding and hence, even when the plunger rod is brought into pressure contact with the inlet valve by stopping the energization of the solenoid, the inlet valve is held at the valve closed position. Immediately after the high-pressure feeding is finished, the piston plunger starts moving toward the bottom dead center (BDC) and, when a pressure in the pressurizing chamber is lowered, the plunger rod and the inlet valve move in the valve opening direction.

SUMMARY OF THE INVENTION

In the related art, after the high-pressure feeding is finished, the plunger rod starts its movement in the valve opening direction and impinges on a fixed core, a stopper or the like (an inlet valve per se may also impinge on a stopper). A drive sound of an engine is tranquil when a vehicle is in an idling state and hence, noises generated by such an impingement cause a serious problem.

It is an object of the present invention to reduce an impinging sound which is generated when a plunger rod of a magnetic solenoid valve impinges on a stopper or the like by reducing a speed at which the plunger rod impinges on the stopper or the like in a suction stroke (phase), for example. The present invention is provided for suppressing the generation of an impact sound generated by the impingement of a valve on a seat or a stroke limiting member (also referred tows a stopper) or by the impingement of an anchor (a part of the plunger) on a core or a stroke limiting member (also referred to as a stopper) in an electromagnetic attraction state where a magnetic solenoid valve is energized so that the valve moves to a full-open position or a full-closed position due to an electromagnetic force against a spring force or in a spring repulsive operation state where the valve moves to the full-closed position or the full-open position by a spring force by cutting the energization from the above-mentioned state.

To achieve the above-mentioned object, according to the present invention, the movement of a valve is electromagnetically decelerated by performing auxiliary energization which adjusts a stroke speed of the valve so that the valve or an anchor (a part of a plunger) is controlled to be silently brought into contact with a member which the valve or the anchor faces.

To be more specific, (in the midst of a compression stroke of a pump, for example), a control method of a magnetic solenoid valve is provided with a limited current supply period which can lower a speed at which the plunger moves to a valve open position, wherein a first current which generates an electromagnetic force necessary for moving a plunger rod toward a valve closed position from a valve open position with a force larger than a spring force for biasing the plunger rod is supplied and, subsequently, a limited current for supplying an electric current smaller than a peak current of the first current during a period where the valve is closed is supplied and, finally (for example, in a suction stroke of the pump), an electric current (second current) smaller than an electric current in a 1st current supply period is supplied.

Due to such a constitution, a consumed current (in a compression stroke of a pump, for example) can be reduced. Further, by supplying the second current (in a suction stroke of the pump, for example), a speed at which the plunger rod moves in the valve opening direction is lowered (without pulling back the plunger rod to the valve closed position) so that noises caused by the impingement can be reduced.

It is also desirable that the limited current supply period includes a hold current period where the plunger is held at the valve closed position and a zero current period which succeeds the hold current period. Due to the provision of such periods, a consumed current can be further reduced. Here, an inlet valve is maintained in a valve closing state due to a back pressure of a pressurizing chamber and hence, there is no possibility that a valve opening operation is performed by the plunger rod during the zero current region.

In applying a control method of a magnetic solenoid valve to a high pressure fuel pump, it is further desirable that, at timing where a plunger piston almost reaches the top dead center, an electric current supplied to an electromagnetic actuator is controlled to zero. Here, the inlet valve is held at a valve closed position by a pressurized fuel pressure. On the other hand, the plunger rod moves in the valve opening direction until the plunger rod engages with the inlet valve. Due to such a control, in a succeeding suction stroke, a distance that the plunger rod moves becomes short so that potential energy of impingement movement can be lowered. Eventually, power consumption can be reduced.

DESCRIPTION OF THE PREFERRED EMBODIMENTS

Embodiments according to the present invention are explained hereinafter in conjunction with drawings.

First Embodiment

Figure 1:
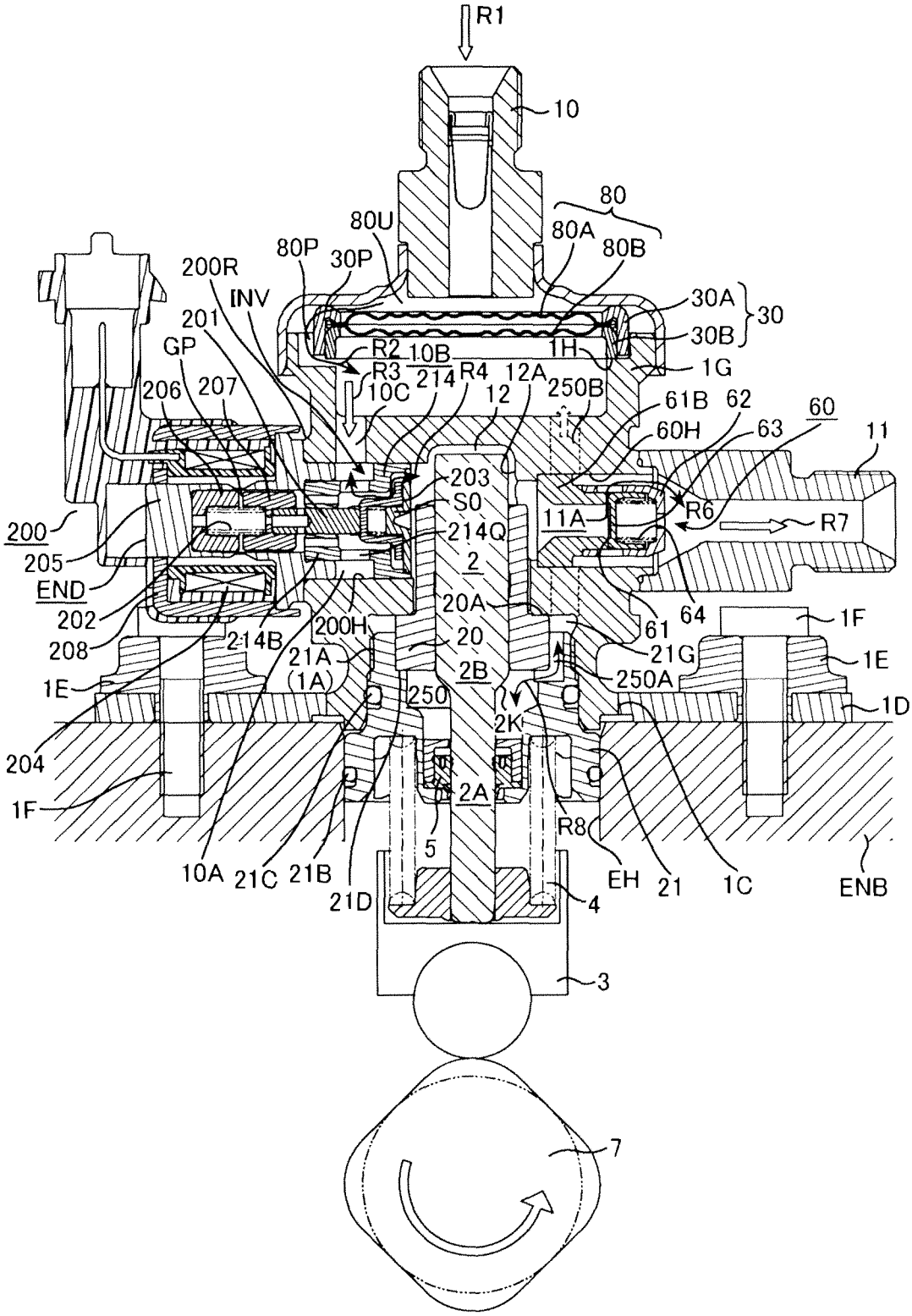
FIG. 1 is an overall longitudinal cross-sectional view of a high pressure fuel pump provided with an electromagnetically controlled inlet valve according to the present invention.

The first embodiment of a high pressure fuel pump in which the present invention is carried out is explained in conjunction with FIG. 1 to FIG. 5. Symbols cannot be given to detailed parts in FIG. 1 and hence, symbols used in the explanation which are not described in FIG. 1 are described in enlarged views including FIG. 2 and succeeding drawings.

A recessed portion 12A which forms a bottomed cylindrical space with one end open is formed on a pump housing 1, and a cylinder 20 is inserted into the recessed portion 12A from an open end side. A gap between an outer periphery of the cylinder 20 and the pump housing 1 is sealed by a pressure contact portion 20A. A piston plunger 2 is slidably fitted into the cylinder 20 and hence, a gap between an inner peripheral surface of the cylinder 20 and an outer peripheral surface of the piston plunger 2 is sealed by fuel which intrudes between both slide fitting surfaces. As a result, a pressurizing chamber 12 is formed between a distal end of the piston plunger 2 and an inner wall surface of the recessed portion 12A and an outer peripheral surface of the cylinder 20.

A cylindrical hole 200H is formed in the pump housing 1 such that the hole 200H is directed toward the pressurizing chamber 12 from a peripheral wall of the pump housing 1, and an inlet valve portion INV of an electromagnetically controlled inlet valve actuator 200 and a part of an electromagnetic drive mechanism portion END are inserted into the cylindrical hole 200H. A joining surface 200R where an outer peripheral surface of the electromagnetically controlled inlet valve actuator 200 and the cylindrical hole 200H are joined to each other is formed by laser welding thus hermetically sealing the inside of the pump housing 1 from atmosphere. The cylindrical hole 200H which is hermetically sealed by mounting the electromagnetically controlled inlet valve actuator 200 in the cylindrical hole 200H functions as a low pressure fuel chamber 10*a*.

A cylindrical hole 60H is formed in the pump housing 1 at a position where the cylindrical hole 60H faces the cylindrical hole 200H in an opposed manner with the pressurizing chamber 12 sandwiched therebetween in a state where the cylindrical hole 60H is directed toward the pressurizing chamber 12 from the peripheral wall of the pump housing 1. An outlet valve unit 60 is mounted in the cylindrical hole 60H. The outlet valve unit 60 includes a valve seat member 61B where a valve seat 61 is formed on a distal end of the valve seat member 61B and a through hole 11A which constitutes an outlet passage is formed at the center of the valve seat member 61B. A valve holder 62 which surrounds the valve-sheet-61-side periphery of the valve seat member 61B is fixed to an outer periphery of the valve seat member 61B. A valve 63 and a spring 64 which biases the valve 63 in the direction that the valve 63 is pushed to the valve seat 61 are arranged in the valve holder 62. A outlet joint 11 which is fixed to the pump housing 1 by welding is provided to an opening portion of the cylindrical hole 60H on a side opposite to the pressurizing chamber 12.

The electromagnetically controlled inlet valve actuator 200 includes an electromagnetically driven plunger rod 201. A valve element 203 is provided adjacent to the plunger rod 201, and the plunger rod 201 faces a valve seat 214S formed on a valve housing 214 which is mounted on an end portion of the electromagnetically controlled inlet valve actuator 200 in an opposed manner.

A plunger rod biasing spring 202 is provided at the other end of the plunger rod 201, and the plunger rod biasing spring 202 biases the plunger rod 201 in the direction that the valve element 203 is separated from the valve seat 214S. A valve stopper S0 is fixed to an inner peripheral portion of a distal end of the valve housing 214. The valve element 203 is held between the valve seat 214S and the valve stopper S0 in a reciprocating manner. A valve biasing spring S4 is arranged between the valve element 203 and the valve stopper S0, and the valve element 203 is biased by the valve biasing spring S4 in the direction that the valve element 203 is separated from the valve stopper S0.

Although the valve element 203 and the distal end of the plunger rod 201 are biased by the respective springs in the directions opposite to each other, the plunger rod biasing spring 202 is formed of a stronger spring compared to the valve biasing spring S4, and the plunger rod 201 pushes the valve element 203 in the direction that the valve element 203 is separated from the valve seat (right direction in the drawing) against a force of the valve biasing spring S4 and, eventually, the valve element 203 is pushed to the valve stopper S0.

Figure 2:
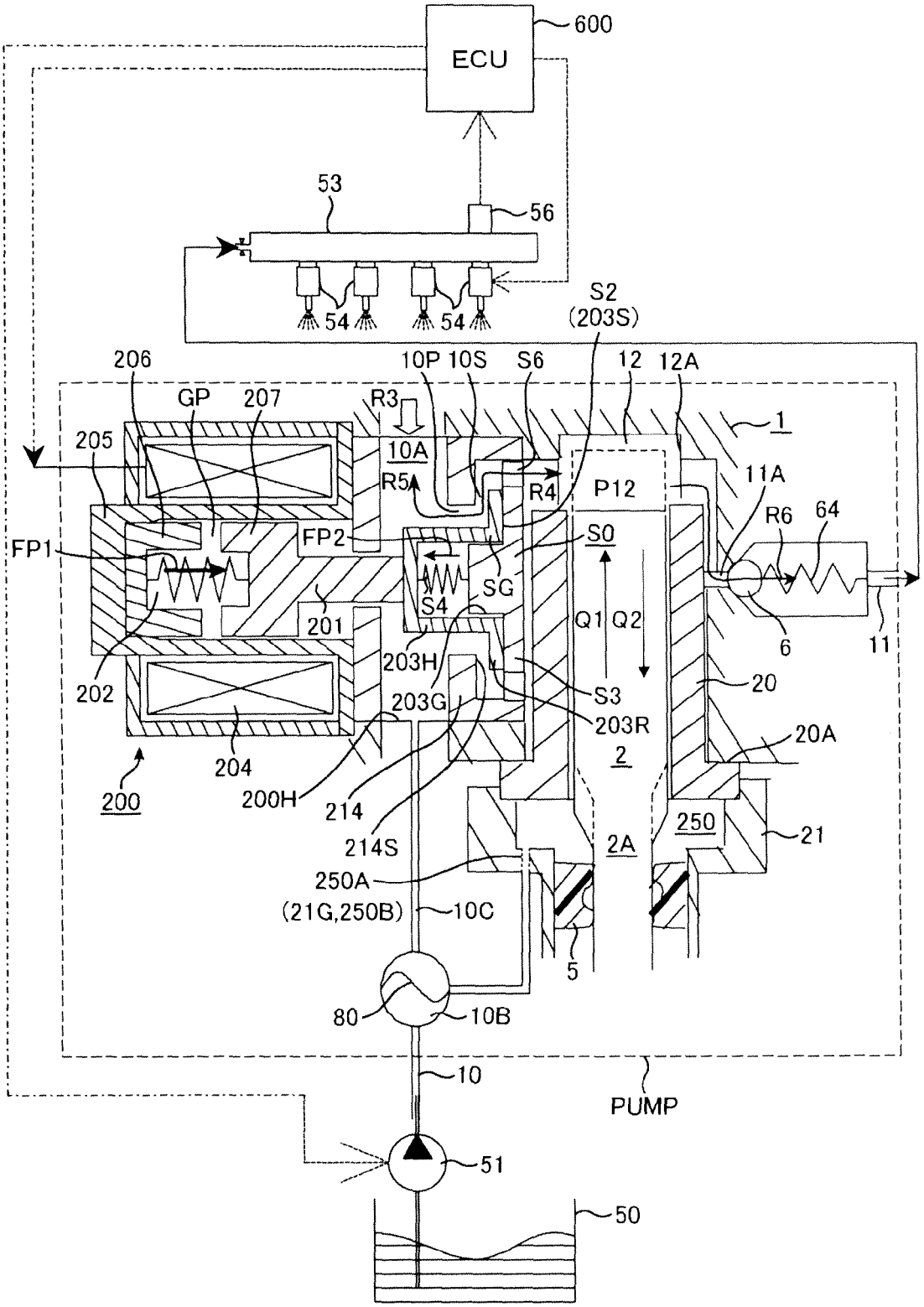
FIG. 2 is a system constitutional view showing one example of a fuel supply system using the high pressure fuel pump in which the present invention is carried out.
Figure 3A:
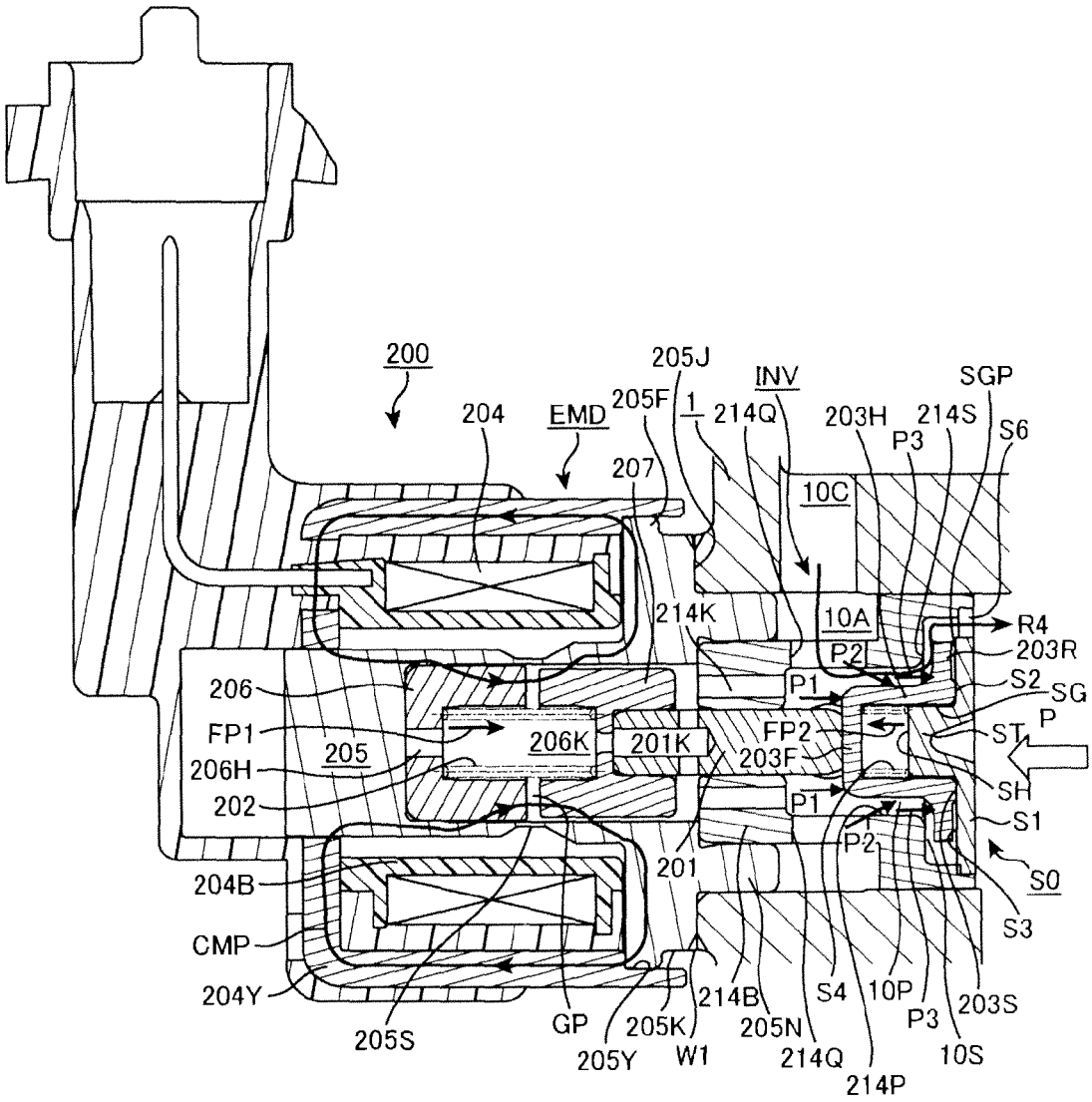
FIG. 3A is an enlarged cross-sectional view of the electromagnetically controlled inlet valve according to a first embodiment in which the present invention is carried out, and also is a view showing a state that the electromagnetically controlled inlet valve is opened so as to suck fuel.

Accordingly, when the electromagnetically controlled inlet valve actuator 200 is in an OFF state (electromagnetic solenoid 204 not being energized), the valve element 203 is biased in the valve opening direction by the plunger rod biasing spring 202 by way of the plunger rod 201. Accordingly, when the electromagnetically controlled inlet valve actuator 200 is in an off state, as shown in FIG. 1, FIG. 2 and FIG. 3A, the plunger rod 201 and the valve element 203 are maintained in a valve opened position (detailed constitution being described later).

Fuel is introduced into an inlet joint 10 which constitutes a fuel introduction port of the pump housing 1 from a fuel tank 50 by a low pressure pump 51.

A plurality of injectors 54 and a pressure sensor 56 are mounted on a common rail 53. The injectors 54 are mounted on the common rail 53 corresponding to the number of cylinders of an engine and inject high-pressure fuel fed to the common rail 53 to the respective cylinders in response to signals from an engine control unit (hereinafter abbreviated as ECU) 600. Further, a relief valve mechanism (not shown in the drawing) which is incorporated in the pump housing 1 opens a valve when pressure in the outlet joint 11 exceeds a predetermined value and returns surplus high pressure fuel to an upstream side of an outlet valve 6.

A lifter 3 mounted on a lower end of the piston plunger 2 is brought into pressure contact with a cam 7 by means of a spring 4. The piston plunger 2 is slidably held by the cylinder 20, and changes a volume in the pressurizing chamber 12 by a reciprocating movement caused by a cam 7 which is rotated by an engine cam shaft or the like. An outer periphery of a lower end portion of the cylinder 20 is held by a cylinder holder 21, and the cylinder 20 is brought into pressure contact with the pump housing 1 by way of a metal seal portion 20A by fixing the cylinder holder 21 to the pump housing 1.

A plunger seal 5 which seals an outer periphery of a small-diameter portion 2A formed on a lower end portion side of the piston plunger 2 is mounted on the cylinder holder 21. An assembled body of the cylinder 20 and the piston plunger 2 is inserted in the pressurizing chamber, and a male threaded portion 21A formed on an outer periphery of the cylinder holder 21 is threaded into a threaded portion 1A of a female threaded portion formed on an inner periphery of an open-side end portion of the recessed portion 12A of the pump housing 1. The cylinder holder 21 pushes the cylinder 20 toward the pressurizing chamber in a state where a stepped portion 21D of the cylinder holder 21 is engaged with a periphery of an end portion of the cylinder 20 on a side opposite to the pressurizing chamber and hence, a sealing stepped portion 20A of the cylinder 20 is pushed to the pump housing 1 thus forming a sealing portion by metal contact.

An O ring 21B seals a gap formed between an inner peripheral surface of a mounting hole EH formed in an engine block ENB and an outer peripheral surface of the cylinder holder 21. An O ring 21C seals a gap between an inner peripheral surface of an end portion of the recessed portion 12A of the pump housing 1 on a side opposite to the pressurizing chamber and the outer peripheral surface of the cylinder holder 21 at a position of the threaded portion 21A (1A) on a side opposite to the pressurizing chamber.

A mounting flange 1D fixed to an outer periphery of an end portion of the pump housing 1 on a side opposite to the pressurizing chamber at a weld portion 1C is, in a state where an outer periphery of the end portion of the cylinder holder 21 is inserted into the mounting hole EH formed in the engine block ENB, threadedly engaged with the engine block by a screw 1F through a screw fixing assist sleeve 1E whereby the pump is fixed to the engine block.

A damper chamber 10*b* is formed in the midst of a passage ranging from the inlet joint 10 to the low pressure fuel chamber 10*a*, and a metal diaphragm damper 80 of a two-sheet metal diaphragm type is housed in the damper chamber 10*b* in a state where the metal diaphragm damper 80 is sandwiched by damper holders 30 (upper damper holder 30A, lower damper holder 30B). The damper chamber 10*b* is formed by joining and welding a lower end portion of a cylindrical side wall of the damper cover 40 on an outer peripheral portion of an annular recessed portion formed on an upper-surface outer wall portion of the pump housing 1. In this embodiment, the inlet joint 10 is fixed to the center of the damper cover 40 by welding.

The metal diaphragm damper 80 is formed such that a pair of upper and lower metal diaphragms 80A, 80B are made to abut to each other, and outer peripheral portions of the metal diaphragms 80A, 80B are welded over the whole circumference thus sealing the inside of the metal diaphragm damper 80. An annular edge portion of an inner-peripheral-side lower end of the upper damper holder 30A is brought into contact with an upper annular edge portion of the metal diaphragm damper 80 inside a weld portion 80C of the metal diaphragm damper 80. An annular edge portion of an inner-peripheral-side upper end of the lower damper holder 30 is brought into contact with a lower annular edge portion of the metal diaphragm damper 80 inside the weld portion 80C of the metal diaphragm damper 80. Due to such a constitution, the metal diaphragm damper 80 has upper and lower surfaces of the annular edge portions thereof sandwiched by the upper damper holder 30A and the lower damper holder 30B.

An outer periphery of the damper cover 40 is formed into a cylindrical shape, is fitted on a cylindrical portion 1G of the pump housing 1. Here, an inner peripheral surface of the damper cover 40 is brought into contact with an annular surface of an upper-end of the upper damper holder 30A so that the metal diaphragm damper 80 is pushed to a stepped portion 1H of the pump housing 1 together with the damper holder 30 whereby the metal diaphragm damper 80 is fixed to the inside of the damper chamber. In this state, the periphery of the damper cover 40 is welded by laser so that the damper cover 40 is joined and fixed to the pump housing 1.

An inert gas such as argon is sealed in a hollow portion formed by the two-sheet-type metal diaphragms 80A, 80B. The hollow portion changes a volume thereof corresponding to a change in external pressure so that the metal diaphragms 80A, 80B perform a pulsation attenuation function. A fuel passage 80U formed between the metal diaphragm damper 80 and the damper cover 40 is communicably connected with the damper chamber 10*b* which constitutes a fuel passage through a passage 30P formed in the upper damper holder 30A and a passage 80P formed between an outer periphery of the upper damper holder 30A and an inner peripheral surface of the pump housing 1. The damper chamber 10*b* is communicated with the low-pressure fuel chamber 10*a* of the electromagnetically controlled inlet valve actuator 200 through a communication hole 10C formed in the pump housing 1 which forms a bottom wall of the damper chamber 10*b*.

A joining portion between the small diameter portion 2A of the piston plunger 2 and a large diameter portion 2B of the piston plunger 2 which is slidably fitted into the cylinder 20 is formed of a conical surface 2K. A sub fuel chamber 250 is formed around the conical surface between the plunger seal and a lower end surface of the cylinder 20. The sub fuel chamber 250 traps fuel leaked from a slide fitting surface between the cylinder 20 and the piston plunger 2.

An annular passage 21G defined between the inner peripheral surface of the pump housing 1 and the outer peripheral surface of the cylinder 20 and an upper end surface of the cylinder holder 21 has one end thereof communicably connected with the damper chamber 10*b* through a vertical passage 250B formed in the pump housing 1 in a penetrating manner, and has the other end thereof communicably connected with the sub fuel chamber 250 through a fuel passage 250A formed in the cylinder holder 21. Due to such a constitution, the damper chamber 10A and the sub fuel chamber 250 are communicated with each other through the vertical passage 250B, the annular passage 21G and the fuel passage 250A.

When the piston plunger 2 moves vertically (reciprocating movement), the conical surface 2K reciprocates in the sub fuel chamber and hence, a volume of the sub fuel chamber 250 changes. When the volume of the sub fuel chamber 250 is increased, fuel flows into the sub fuel chamber 250 from the damper chamber 10*b* through the vertical passage 250B, the annular passage 21G and the fuel passage 250A. When the volume of the sub fuel chamber 250 is reduced, fuel flows into the damper chamber 10*b* from the sub fuel chamber 250 through the vertical passage 250B, the annular passage 21G and the fuel passage 250A.

When the piston plunger 2 is lifted from the bottom dead center in a state where the valve element 203 is maintained in a valve opened position (a state where the solenoid 204 is not energized), fuel sucked into the pressurizing chamber overflows (spills) into the low-pressure fuel chamber 10*a* from the valve element 203 in an opened state, and flows into the damper chamber 10*b* through the communication hole 10C. Accordingly, the high-pressure fuel pump is configured such that fuel from the suction joint 10, fuel from the sub fuel chamber 250, overflowed fuel from the pressurizing chamber 12 and fuel from the relief valve (not shown in the drawing) are merged in the damper chamber 10*b*. As a result, the fuel pulsations which the respective fuels have are merged in the damper chamber 10*b*, and the merged fuel pulsations are absorbed by the metal diaphragm damper 80.

In FIG. 2, a portion surrounded by a broken line indicates a pump body portion shown in FIG. 1. The electromagnetically controlled inlet valve actuator 200 includes a bottomed cup-shaped yoke 205 which also functions as a body of the electromagnetic drive mechanism portion END on an inner peripheral side of the solenoid 204 formed in an annular shape. In an inner peripheral portion of the yoke 205, a fixed core 206 and an anchor 207 are housed with the plunger rod biasing spring 202 sandwiched therebetween.

Figure 3B:
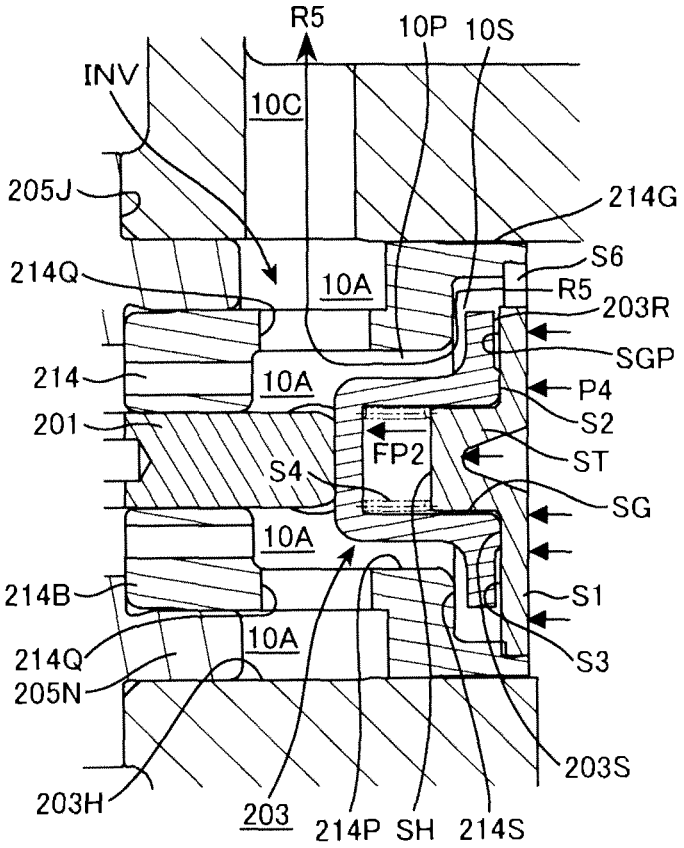
FIG. 3B is an enlarged cross-sectional view of the electromagnetically controlled inlet valve according to the first embodiment in which the present invention is carried out, and also is a view showing a state where the electromagnetically controlled inlet valve is opened so as to perform fuel overflowing (spilling)

FIG. 3A and FIG. 3B show the structure of electromagnetically controlled inlet valve actuator 200 and the periphery of the electromagnetically controlled inlet valve actuator 200 in a state where the valve element 203 is opened. The fixed core 206 is firmly fixed to a bottomed portion of the yoke 205 by press-fitting. The anchor 207 is fixed to an end portion of the plunger rod 201 on a side opposite to the valve by press-fitting, and faces the fixed core 206 with a magnetic gap GP interposed therebetween. The solenoid 204 is housed in a cup-shaped side yoke 204Y, and the side yoke 204Y and the yoke 205 are fixed to each other by fitting an outer peripheral portion of an annular flange portion 205F of the yoke 205 into an inner peripheral surface of an open end portion of the side yoke 204Y. A closed magnetic path CMP which traverses the magnetic gap GP is formed around the solenoid 204 by the yoke 205, the side yoke 204Y, the fixed core 206 and the anchor 207. A portion of the yoke 205 which faces the periphery of the magnetic gap GP in an opposed manner is formed with a small wall thickness thus forming a magnetic throttle 205S. Due to such a constitution, a magnetic flux which leaks through the yoke 205 is reduced and hence, a magnetic flux which passes through the magnetic gap GP can be increased.

The valve housing 214 having a bearing 214B is fixed to an inner peripheral portion of a cylindrical portion 205N on an open-side end portion of the yoke 205 by press-fitting, and the plunger rod 201 passes through the bearing 214B and extends to the valve element 203 which is mounted on an inner peripheral portion of an end portion of the valve housing 214 on a side opposite to the bearing 214B. In an annular stepped inner peripheral surface 214D of an end portion of the valve housing 214 on a side opposite to the bearing 214B (shown in FIG. 4A), three press-fitting surface portions Sp1 to Sp3 of the valve stopper S0 are fitted by press-fitting, and these press fitting surface portions Sp1 to Sp3 are fixed to the inner peripheral surface 214D by laser welding. A width of a press-fitting stepped portion of the inner peripheral surface 214D and widths of three press fitting surface portions Sp1 to Sp3 in the press fitting direction have the same size.

The plunger rod biasing spring 202 biases the valve element 203 to a valve open position by way of the plunger rod 201. The valve biasing spring S4 is sandwiched between the valve element 203 and the valve stopper S0, and biases the valve in the valve closing direction (leftward direction in the drawing). A biasing force of the valve biasing spring S4 in the valve closing direction is set smaller than a biasing force of the plunger rod biasing spring 202 in the valve opening direction and hence, in such a state, the valve element 203 is biased in the valve opening direction (rightward direction in the drawing).

The valve element 203 has an annular surface portion 203R which faces a valve seat 214S in an opposed manner, a bottomed cylindrical portion which extends to a distal end of the plunger rod 201 is formed on a center portion of the annular surface portion 203R, and the bottomed cylindrical portion is constituted of a bottom flat portion 203F and a cylindrical portion 203H. The cylindrical portion 203H projects to the inside of the low pressure fuel chamber 10*a* while passing through an opening portion 214P formed in the valve housing 214 inside the valve seat 214S.

A distal end of the plunger rod 201 is brought into contact with a surface of the planar portion 203F of a plunger-rod-side end portion of the valve element 203 in the low pressure fuel chamber 10*a*. Four fuel communication holes 214Q are formed in a cylindrical portion defined between the bearing 214B and an opening portion 214P of the valve housing 214 equidistantly in the circumferential direction. These four fuel communication holes 214Q make the low-pressure fuel chambers 10*a* inside and outside the valve housing 214 communicate with each other. A cylindrical fuel introducing passage 10*p* which is communicated with an annular fuel passage 10S formed between the valve seat 214S and the annular surface portion 203R is formed between an outer peripheral surface of the cylindrical portion 203H and the peripheral surface of the opening portion 214P.

The valve stopper S0 includes a projecting portion ST having a cylindrical surface portion SG which projects toward the bottomed cylindrical portion of the valve element 203 at a center portion of an annular surface portion S3, wherein the cylindrical surface portion SG functions as a guide portion which guides stroking of the valve element 203 in the axial direction.

The valve biasing spring S4 is held between a valve-side end surface SH of the projecting portion ST of the valve stopper S0 and a bottom surface of the bottomed cylindrical portion of the valve element 203.

When the valve element 203 is guided by the cylindrical surface portion SG of the valve stopper S0 and is stroked to a full open position, an annular projecting portion 203S formed on a center portion of the annular surface portion 203R of the valve element 203 is brought into contact with a receiving surface S2 (width: HS2) of the annular surface portion S3 (width: HS3) of the valve stopper S0. Here, an annular gap SGP is formed around the annular projecting portion 203S. This annular gap SGP makes a pressure P4 of fuel on a pressurizing chamber side act on the valve element 203 when the valve element 203 starts the movement in the valve closing direction thus performing a quick separation function which makes the valve element 203 quickly separate from the valve stopper S0.

Figure 4A:
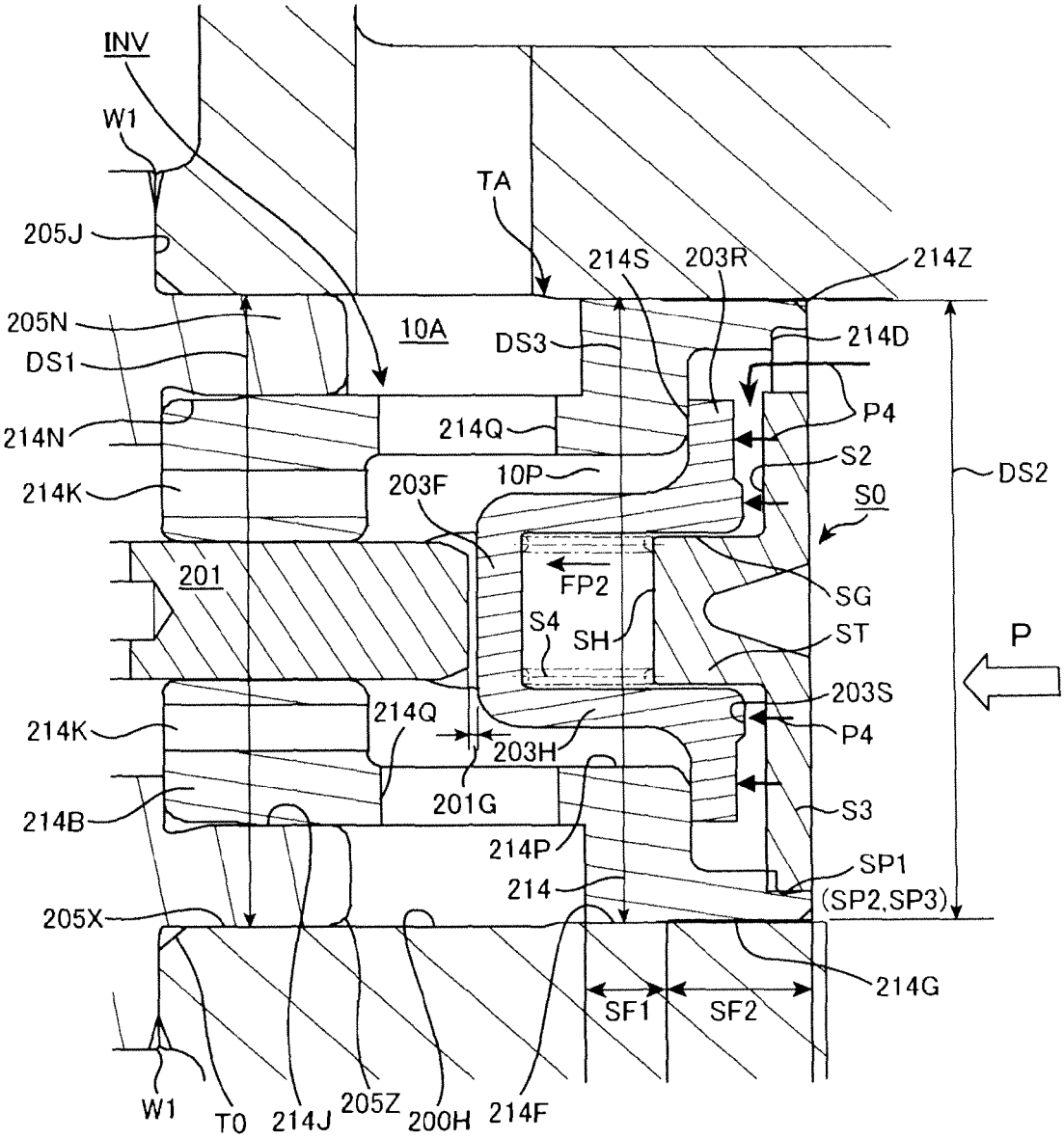
FIG. 4A is an enlarged cross-sectional view of the electromagnetically controlled inlet valve according to the first embodiment in which the present invention is carried out, and also is a view showing a closed valve state of the electromagnetically controlled inlet valve.

FIG. 4A shows the valve element and parts around the valve element when the valve element 203 is in a valve closed state. In a valve closed state, the electromagnetic solenoid 204 is energized, and the anchor 207 (shown in FIG. 3A) is biased in the leftward direction in the drawing by an electromagnetic force. Although a force of the plunger rod biasing spring 202 biases the anchor 207 in the rightward direction in the drawing, this force is set weaker than the electromagnetic force and hence, eventually, both the anchor 207 and the plunger rod 201 are biased in the leftward direction in the drawing. Accordingly, the distal end of the plunger rod 201 is separated from the flat portion 203F of the valve element 203 so that a gap 201G is formed between the distal end of the plunger rod 201 and the flat portion 203F of the valve element 203. Due to the presence of the gap 201G, the valve element 203 is completely released from the engagement with the plunger rod 201 so that the valve element 203 moves until a gap formed between the valve seat 214S and the annular surface portion 203R becomes zero whereby the valve element 203 can be moved to a completely valve closed position. Although it is desirable that the gap 201G is as small as possible, in the actual manufacture, due to the tolerance in manufacture or the like, a finite gap which is always larger than zero exists.

Figure 4B:
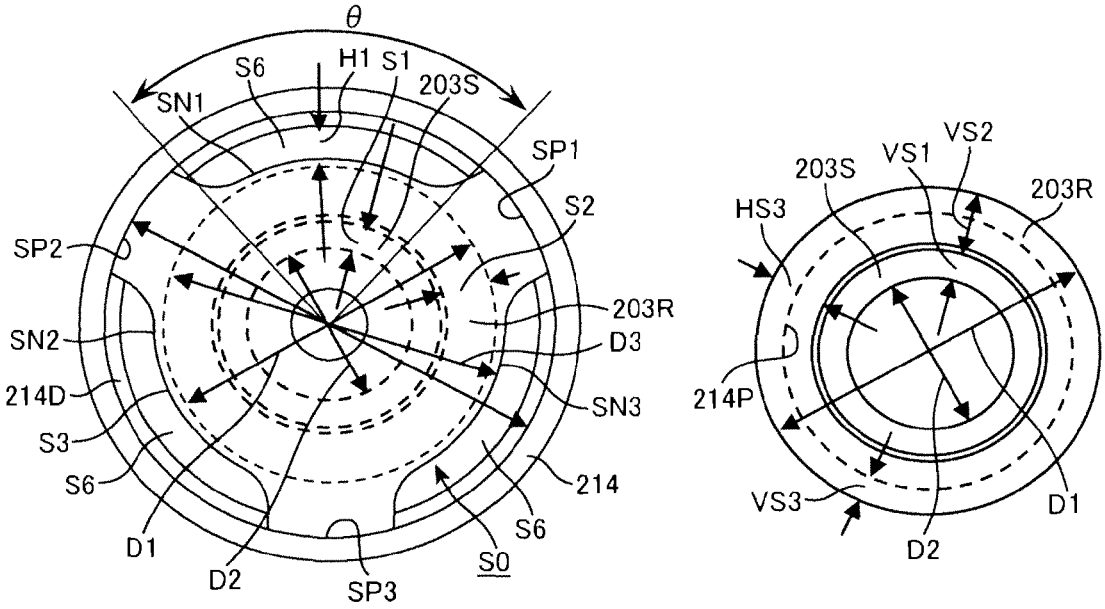
FIG. 4B is an enlarged cross-sectional view of the electromagnetically controlled inlet valve according to the first embodiment in which the present invention is carried out, and also is a view as viewed in the direction indicated by an arrow P in FIG. 3A and FIG. 4A, wherein a light side of the drawing is a view of a stopper as viewed in the direction indicated the arrow P, and a left side of the drawing is a view of a valve as viewed in the direction indicated by the arrow P.

As shown in FIG. 4B, the valve stopper S0 is provided with the press-fitted surface portions Sp1 to Sp3 which are formed on an outer peripheral surface of the valve stopper S0 at three positions at specific intervals. Further, notches Sn1, Sn2, Sn3 having a width H1 in the radial direction are arranged between the respective press-fitting surface portions Sp1 (Sp2, Sp3) at an angle θ in the circumferential direction. The plurality of press-fitting surfaces Sp1 to Sp3 of the valve stopper S0 are press-fitted into a cylindrical inner peripheral surface of the valve housing 214 downstream of the valve seat 214S, and between the press-fitting portion and the press-fitting portion, three valve seat downstream fuel passages S6 having a width H1 are formed between a peripheral surface of the valve stopper and an inner peripheral surface of the valve housing 214 over an angle θ in the circumferential direction. This valve seat downstream fuel passage S6 formed as a fuel passage having a large area further outside the outer peripheral surface of the valve element 203 and hence, a passage area of the valve seat downstream side fuel passage S6 can be set larger than a passage area of the annular fuel passage 10S formed in the valve seat 214S. As a result, the valve seat downstream side fuel passage S6 does not become the passage resistance with respect to the inflow of the fuel into the pressurizing chamber and the outflow of fuel from the pressurizing chamber and hence, the flow of fuel becomes smooth.

In FIG. 4B, a diameter D1 of the outer peripheral surface of the valve element 203 is set slightly smaller than a diameter D3 of a notched portion of the valve stopper S0. As a result, in FIG. 3B, when fuel is in a spilling state where fuel flows into the low pressure fuel chamber and the damper chamber 10*b* from the pressurizing chamber along a fuel flow R5, static and dynamic fluid forces of fuel on a pressurizing chamber 12 side indicated by an arrow P4 hardly acts on the annular surface portion 203R of the valve element 203. Accordingly, it is unnecessary for the plunger rod biasing spring 202 which imparts a force for pushing the valve element 203 to the valve stopper S0 to receive all fluid force P4 in such a state and hence, a spring which is weak correspondingly can be used. As a result, an electromagnetic force which magnetically attracts the anchor 207 to the fixed core 206 against a force of the plunger rod biasing spring 202 at valve closing timing of the valve element 203 and separates the plunger rod 201 from the valve element 203 as shown in FIG. 4A can be made small. Accordingly, a magneto motive force of the solenoid 204 can be made small so that it is possible to acquire advantageous effects that, for example, the electromagnetic drive mechanism portion END can be made small by reducing the number of winding of a conductive line of the solenoid 204, and a heating value can be reduced by reducing a drive current, for example.

The diameter D1 of the annular surface portion 203R of the valve element 203 is set 1.5 to 3 times as large as a diameter D2 of an inner peripheral surface which receives a valve guide formed by the cylindrical surface portion SG of the projecting portion ST of the valve stopper S0 formed at a center portion of the annular surface portion 203R. A width VS1 in the radial direction of the annular projecting portion 203S which is brought into contact with the receiving surface S2 (width: HS2) of the annular surface portion S3 (width: HS3) of the valve stopper S0 formed outside the annular surface portion 203R is set smaller than a width VS2 of the annular gap SGP formed outside the annular surface portion S3. Further, the valve seat 214 is formed on a portion having a width VS3 of the annular surface portion 203R of the valve element 203 retracted toward the inside from an outer periphery of the annular surface portion 203R. As a result, an acting force of fuel from a low pressure fuel chamber 10*a* side when the valve element 203 opens and an acting force of fuel which acts on the valve from a pressurizing chamber side at the time of performing a valve closing operation of the valve element 203 act in the radial direction of the valve element 203 uniformly and in a well balanced manner whereby a play of the valve element 203 in the radial direction and a force which inclines the valve element 203 in the inclination direction with respect to a center axis of the valve element 203 can be reduced whereby valve opening and closing operation of the valve element 203 can be performed smoothly due to a synergistic effect with guiding by the cylindrical surface portion SG of the valve stopper S0. This provision is important when a small valve having a diameter of several mm and a weight of several g is used in a place where the flow rate is high and the direction of the flow is reversed within a short time.

The insertion hole 200H having a diameter of DS1 into which the inlet valve portion INV is inserted has a tapered portion TA on an intermediate portion thereof in the inserting direction, and a diameter DS3 on a pressurizing chamber side than the tapered portion TA is set smaller than the diameter DS1. Outer diameters of cylindrical portions 214F, 214G of the valve housing 214 positioned on a distal end portion of the inlet valve portion INV are set smaller in a zone SF2 (cylindrical portion 214G) than in a zone SF1 (cylindrical portion 214F) on an outer periphery of the distal end portion. The outer diameter of the cylindrical portion 214F in the zone SF1 is set larger than the diameter DS1 of the insertion hole 200H so that the inlet valve portion INV is fitted into the insertion hole 200H of the pump housing 1 by tight fitting. In the zone SF2, the outer diameter of the cylindrical portion 214G is set smaller than the diameter DS1 of the insertion hole 200H and hence, the inlet valve portion INV is loosely fitted into the insertion hole 200H at such a portion. This provision is adopted for facilitating the insertion of the inlet valve portion INV by enabling a tapered portion TO of an inlet portion to perform an automatic centripetal function of regulating the distal end portion of the valve housing 214 at the time of inserting the inlet valve portion INV into the insertion hole 200H and for preventing the insertion of the inlet valve portion INV in an inclined posture by an automatic centripetal operation performed by the tapered portion TA formed inside the insertion hole 200H. Accordingly, a yield at the time of automatically assembling the high pressure fuel pump can be enhanced. Further, assembling can be achieved by merely performing only a press fitting of a fluid seal on a pressurizing chamber 12 side and a low-pressure fuel chamber 10*a* side with respect to the tight fitting portion 214F and hence, the operability of automatic assembling can be improved.

By setting sizes of a distal-end edge portion of the valve housing and a distal-end edge portion of the yoke 205 such that the distal-end edge portion of the yoke 205 is about to reach the tapered portion TO when the distal-end edge portion of the valve housing almost reaches the tapered portion TA, a centering action at the time of assembling can be achieved at a time and hence, operability is enhanced and the number of defects in assembling can be reduced.

An outer diameter of the distal end portion of the yoke 205 inserted into the insertion hole 200H is set smaller than the inner diameter DS1 of the insertion hole 200H thus bringing about a loose fitting state between both parts. This structure has an advantageous effect of shortening an operation time of an automatic inserting operation by reducing an inserting force of the inlet valve portion INV as much as possible. When the yoke 205 is completely inserted into the insertion hole 200H, a joining end surface 205J of the yoke 205 is brought into contact with a mounting surface of the pump housing 1. In such a state, the whole circumference of a joining portion W1 is welded by laser welding thus hermetically sealing the inside of the insertion hole 200H and fixing the electromagnetic drive mechanism portion END to the pump housing 1.

With respect to an outer diameter of the bearing 214B of the valve housing 214, a diameter of a valve-side end-portion-side press-fitting portion 214J of the yoke 205 is set smaller than a diameter of a distal end portion 214N of an end portion of the yoke 205 on a side opposite to the valve element 203. This provision is adopted for acquiring an automatic centering effect at the time of press-fitting the bearing 214B in an inner peripheral surface of the cylindrical projecting portion 205N formed on the distal end of the yoke 205. A plurality of fuel communication holes 214K are formed in the bearing 214B. When the anchor 207 reciprocates, fuel flows in or flows out through the fuel communication holes 214K and hence, an operation of the anchor 207 becomes smooth.

Further, fuel flows in and flows out through the fuel communication holes 201K formed in the plunger rod 201, a space 206K between the fixed core 206 and the anchor 207 where the plunger rod biasing spring 202 is housed, and the periphery of the anchor 207. Accordingly, the operation of the anchor 207 becomes further smoother. The fuel communication holes 201K have an advantageous effect of preventing the space 206K from being brought into a completely closed state when the fixed core 206 and the anchor 207 are brought into contact with each other. Due to such a constitution, it is possible to prevent the occurrence of a drawback that when the anchor 207 and the plunger rod 201 start a valve opening movement toward a right side in the drawing by the plunger rod biasing spring 202, the pressure is instantaneously lowered so that the valve opening movement is delayed.

The valve element 203 is mounted in such a manner that the valve element 203 is movable in a reciprocating manner between a valve open position and a valve closed position. At the time of closing the valve, the valve element 203 is brought into contact with the valve seat 214S formed on the valve housing 214 and hence, a stroke is restricted, while at the time of opening the valve, the annular projecting portion 203S of the valve element 203 is brought into contact with the receiving surface S2 of the valve stopper S0 and hence, the stroke is restricted. In a valve open state shown in FIG. 3B, a stroke distance of the open/close valve is shown as the gap VGS formed between the valve seat 214S and the valve element 203 which faces the valve seat 214S in an opposed manner. Further, in a valve closed state shown in FIG. 4A, the stroke distance of the open/close valve becomes a gap between the annular projecting portion 203S and the receiving surface S2 which faces the annular projecting portion 203S in an opposed manner (the distance substantially equal to the previously mentioned gap VGS).

The manner of operation of the first embodiment is explained in conjunction with FIG. 1, FIG. 2, FIG. 3A, FIG. 3B, FIG. 4A, FIG. 4B and FIG. 5.

<<Spilling Stroke>>

Firstly, a state where the piston plunger 2 is at a bottom dead center position is explained. Here, the inside of the pressurizing chamber 12 is filled with fuel, and the solenoid 204 shown in FIG. 3A assumes a non-energized state. Due to a biasing force of the plunger rod biasing spring 202, the plunger rod 201 is biased in the direction indicated by an arrow SP1 thus biasing the valve element 203 in the valve opening direction.

Figure 5:
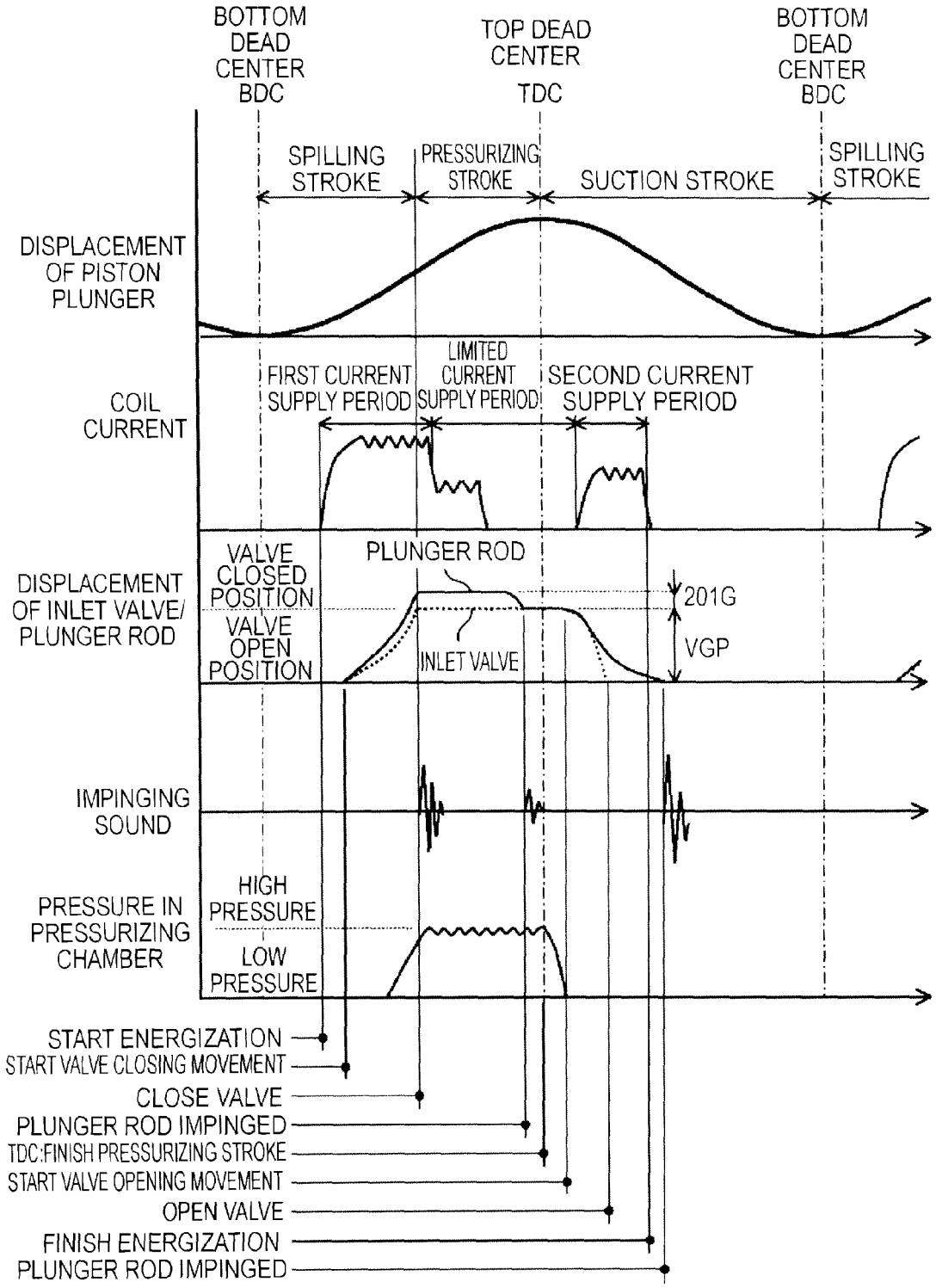
FIG. 5 is a view for explaining a control state of the electromagnetically controlled inlet valve according to the first embodiment in which the present invention is carried out.

When the piston plunger 2 passes the bottom dead center position, the piston plunger 2 starts to lift in the direction indicated by an arrow Q1 in FIG. 2. Here, the solenoid 204 shown in FIG. 3A is maintained in a non-energized state for a predetermined period corresponding to an operation state of the engine. Due to such a maintaining operation, the valve element 203 is maintained in a valve open state and, during this period, fuel sucked into the pressurizing chamber 12 is spilled (overflowed) to the low pressure fuel chamber 10*a* through the fuel passage S6, the annular fuel passage 10S and the fuel introducing passage 10P along an arrow R5 shown in FIG. 3B. The longer a period during which fuel is spilled, the smaller a flow rate of fuel which the pump compresses becomes. The ECU 600 adjusts an amount of fuel which the high pressure fuel pump compresses by adjusting a length of the period of this fuel spilling state. FIG. 5 schematically shows the respective displacements of the piston plunger 2, the valve element 203 and the plunger rod 201 in the spilling stroke.

Fuel in the pressurizing chamber 12 flows into the low pressure fuel chamber 10*a* through the fuel passage S6, the annular fuel passage 10S and the fuel introducing passage 10P in this order. Here, a fuel-passage cross-sectional area of the annular fuel passage 10S is set smaller than fuel-passage cross-sectional areas of the fuel passage S6 and the fuel introducing passage 10P. That is, the fuel-passage cross-sectional area of the annular fuel passage 10S is set to the smallest value. Accordingly, although a pressure loss is generated in the annular fuel passage 10S so that a pressure in the pressurizing chamber 12 starts to be increased, an annular surface of the valve stopper S0 on a pressurizing chamber side receives a fluid pressure P4 of fuel and hence, a force which acts on the valve element 203 can be reduced.

With respect to the annular gap SGP, in a spilling state, fuel flows to the damper chamber 10*b* from the low pressure fuel chamber 10*a* through four fuel communication holes 214Q. On the other hand, when the piston plunger 2 is lifted, a volume of the sub fuel chamber 250 is increased. Accordingly, due to the flow of fuel in the direction indicated by a downwardly extending arrow R8 through the vertical passage 250E, the annular passage 21G and the fuel passage 250A, some of fuel is introduced into the sub fuel chamber 250 from the damper chamber 10*b*.

<<Pressurizing Stroke>>

In the transition from the spilling stroke to the pressurizing stroke, the ECU 600 gives the solenoid 204 an energization command. The period during which the command is given is indicated as a 1st current supply period in FIG. 5. An electric current which flows in the solenoid 204 is increased with a delay caused by inductance intrinsic to a solenoid. Here, a closed magnetic path CMP shown in FIG. 3A is formed and a magnetic attraction force is generated in a magnetic gap GP between opposedly facing faces of the fixed core 206 and the anchor 207. The magnetic attraction force is also increased along with the increase of the electric current. When the magnetic attraction force becomes larger than a biasing force of the plunger rod biasing spring 202, the anchor 207 and the plunger rod 201 which is fixed to the anchor 207 are attracted in the direction toward the fixed core 206. Here, fuel in the magnetic gap GP and the accommodation chamber 206K for accommodating the plunger rod biasing spring 202 is discharged to the low pressure passage from the fuel passage 214K through the fuel communication holes 201K and the periphery of the anchor 207. Due to such a constitution, the anchor 207 and the plunger rod 201 can be moved toward a fixed core 206 side at a high speed with small fluid resistance. When the anchor 207 impinges on the fixed core 206, the anchor 207 and the plunger rod 201 stop the movement. Due to such impingement, a first noise is generated.

An electric current in the 1st current supply period is set such that a magnetic attraction force becomes larger than a biasing force of the plunger rod biasing spring 202. The anchor 207 can perform an attraction operation even when an electric current more than necessity is supplied to the solenoid 204. In this case, however, the heat is generated excessively. Accordingly, the supply of an excessively large electric current is not desirable. In this embodiment, the current control circuit is provided and setting is made such that when an electric current reaches a predetermined current value, the electric current is held for a predetermined period (period of 1st current supply period). Due to such a control, the anchor 207 can be attracted without applying an electric current more than necessity thus reducing a heating value during this period. On the other hand, even when such a current control circuit is not used, the substantially same advantageous effect can be acquired by performing a duty control on a current supply amount by setting in advance timing at which an electric current is expected to reach a predetermined electric current. Either one of these current control methods is applicable to the present invention.

When the plunger rod 201 is attracted to a fixed core 206 side, the engagement of the valve element 203 with the plunger rod 201 is released so that the valve element 203 starts to move in the valve closing direction due to a biasing force of the valve biasing spring S4 and a fluid force generated by the fuel flow R5. Here, the fluid force means a differential pressure force which is generated when a pressure in the pressurizing chamber 12 which is increased due to the fuel flow R5 is applied to the inside of the annular gap SGP positioned on an outer peripheral side of the annular projecting portion 203S or the like.

When the valve element 203 is brought into contact with the valve seat 214S, a valve closed state is brought about. Here, the engagement of the plunger rod 201 with the valve element 203 is completely released so that the gap 201G is formed between the distal end of the plunger rod 201 and the bottom flat portion 203F of the valve element 203.

The valve element 203 and the plunger rod 201 are members separate from each other and hence, when a moving speed of the plunger rod 201 is higher than a moving speed of the valve element 203, there may be a case where the plunger rod 201 is separated from the valve element 203. To the contrary, when a moving speed of the plunger rod 201 is relatively lower than a moving speed of the valve element 203, there may be a case where the plunger rod 201 is moved together with the valve element 203.

When the piston plunger 2 is lifted succeedingly, a volume of the pressurizing chamber 12 is reduced so that, as shown in a pressurizing stroke period in FIG. 5, a pressure in the pressurizing chamber 12 is increased. When the pressure in the pressurizing chamber 12 becomes higher than a pressure in the outlet joint 11, as shown in FIG. 1 and FIG. 2, an outlet valve 63 of the outlet valve unit 60 is separated from the valve seat 61 and hence, fuel is discharged in the direction along an arrow R6 and an arrow R7 from the outlet passage 11*a* through the outlet joint 11.

As shown in FIG. 5, a limited current supply period starts in the midst of the movement of the plunger rod 201 in the valve closing direction or at a point of time that the movement of the plunger rod 201 is finished. In this period, firstly, a supply current is lowered to a current value lower than a current value of a supply current in the 1st current supply period. The anchor 207 is in the midst of the movement in the valve closing direction or the movement of the anchor 207 is finished and hence, a magnetic gap GP between the opposedly facing faces of the fixed core 206 and the anchor 207 is set narrow. Accordingly, it is possible to attract the plunger rod 201 in the valve closing direction by generating a larger magnetic attraction force with a current value lower than a current value in the first current supply period.

An amount of electric current which is given in the limited current supply period may be sufficient provided that the plunger rod 201 can be attracted and held (referred to as a holding current in general). By providing the limited current supply period, it is possible to realize the reduction of a heating value of the solenoid and the reduction of power consumption.

Subsequently, within a period where a pressure in the pressurizing chamber 12 is high in the limited current supply period, an electric current is lowered to zero or a value close to zero (a small current value by which the plunger rod 201 cannot be attracted and held). Due to such an operation, a magnetic attraction force generated between the opposedly facing faces of the fixed core 206 and the anchor 207 is weakened so that the anchor 207 and the plunger rod 201 start movement toward a valve element 203 side (in the valve opening direction) due to a biasing force of the plunger rod biasing spring 202, and moves until the plunger rod 201 impinges on the bottom flat portion 203F of the valve element 203. Here, a pressure in the pressurizing chamber 12 is high so that the high pressure is applied to the valve element 203 and hence, even when the plunger rod 201 impinges on the valve element 203, the valve is not opened. That is, the plunger rod 201 moves by an amount corresponding to the gap 201G which exists before the plunger rod 201 starts movement, and impinges on the valve element 203. When the plunger rod 201 impinges on the valve element 203, a second noise is generated. By lowering the current value to zero during this period, it is possible to realize the further reduction of a heating value of the solenoid and the further reduction of power consumption. Further, although the explanation is made next, the gap 201G formed at the distal end of the plunger rod 201 is narrowed and hence, a distance of next movement of the plunger rod 201 is shortened. Further, the current value is set to zero once and hence, a control of an electric current performed thereafter is facilitated.

<<Suction Stroke>>

When the piston plunger 2 passes the top dead center, the pump enters the suction stroke where a volume of the pressurizing chamber 12 is increased due to the descending movement of the piston plunger 2 so that a pressure in the pressurizing chamber 12 is reduced. The pressure in the pressurizing chamber 12 is lowered to a pressure equal to or lower than the pressure in the low pressure fuel chamber 10*a* so that a valve closing force of the valve element 203 generated by the pressure in the pressuring chamber 12 disappears and a valve opening force is generated due to the differential pressure. Here, a current value of the solenoid 204 is maintained at zero or a value close to zero and hence, a magnetic attraction force is not generated whereby the plunger rod 201 continues to bias the valve element 203 in the valve opening direction and starts the movement thereof in the valve opening direction together with the valve element 203. The plunger rod 201 is formed as a member separate from the valve element 203 and hence, the plunger rod 201 is moved in the valve opening direction together with the valve element 203 or is separated from the valve element 203 in the midst of the movement.

A 2nd current supply period starts at a point of time that the piston plunger 2 passes the top dead center, and a current value lower than a current value in the 1st current supply period is given in the 2nd current supply period. Accordingly, a magnetic attraction force is generated between the opposedly facing faces of the fixed core 206 and the anchor 207 so that energy of the plunger rod 201 which moves in the valve opening direction is reduced. In the case where the plunger rod 201 is moved in the valve opening direction together with the valve element 203, by alleviating a speed of the plunger rod 201, a speed at which the valve element 203 impinges on the valve stopper S0 can be alleviated. As a result, noises generated when the valve element 203 impinges on the valve stopper S0 can be reduced. On the other hand, in the case where the plunger rod 201 is separated from the valve element 203 and the valve element 203 is brought into contact with the valve stopper S0 prior to the impingement of the plunger rod 201 on the valve element 203, a speed at which the plunger rod 201 impinges on the valve element 203 is alleviated and hence, impinging noises can be reduced. In any case, by lowering a speed at which the plunger rod 201 moves in the valve opening direction in the suction stroke, the generation of noises can be alleviated. The noises generated here are referred to as third noises.

Here, when a current value given in the 2nd current supply period is excessively large, not to mention that energy of the plunger rod 201 is reduced, the plunger rod 201 is moved in the valve closing direction to the contrary. Accordingly, it is necessary to set a current value given in the 2nd current supply period to a relatively low value. As a reference value, it is desirable to set a current value given in the 2nd current supply period lower than at least a peak current in the 1st current supply period.

Further, in the constitution of the present invention, the movement of the plunger rod 201 is divided in two ranging from the spilling stroke to the suction stroke. This division of the movement of the plunger rod 201 is realized such that, as described in What is claims is, the limited current supply period is provided before the piston plunger 2 passes the top dead center (a state where an inner pressure of the pressurizing chamber 12 is high), and a drive current is set to zero during the limited current supply period thus moving only the plunger rod 201. Due to such an operation, the plunger rod 201 moves a distance 201G in the limited current supply period, and moves a remaining distance VGS in periods succeeding the 2nd current supply period. Although the number of times that impingement occurs becomes two, the moving distance per one movement becomes short and hence, potential of kinetic energy in each movement becomes low whereby the constitution of the present invention is advantageous for the reduction of peak noises.

Figure 6:
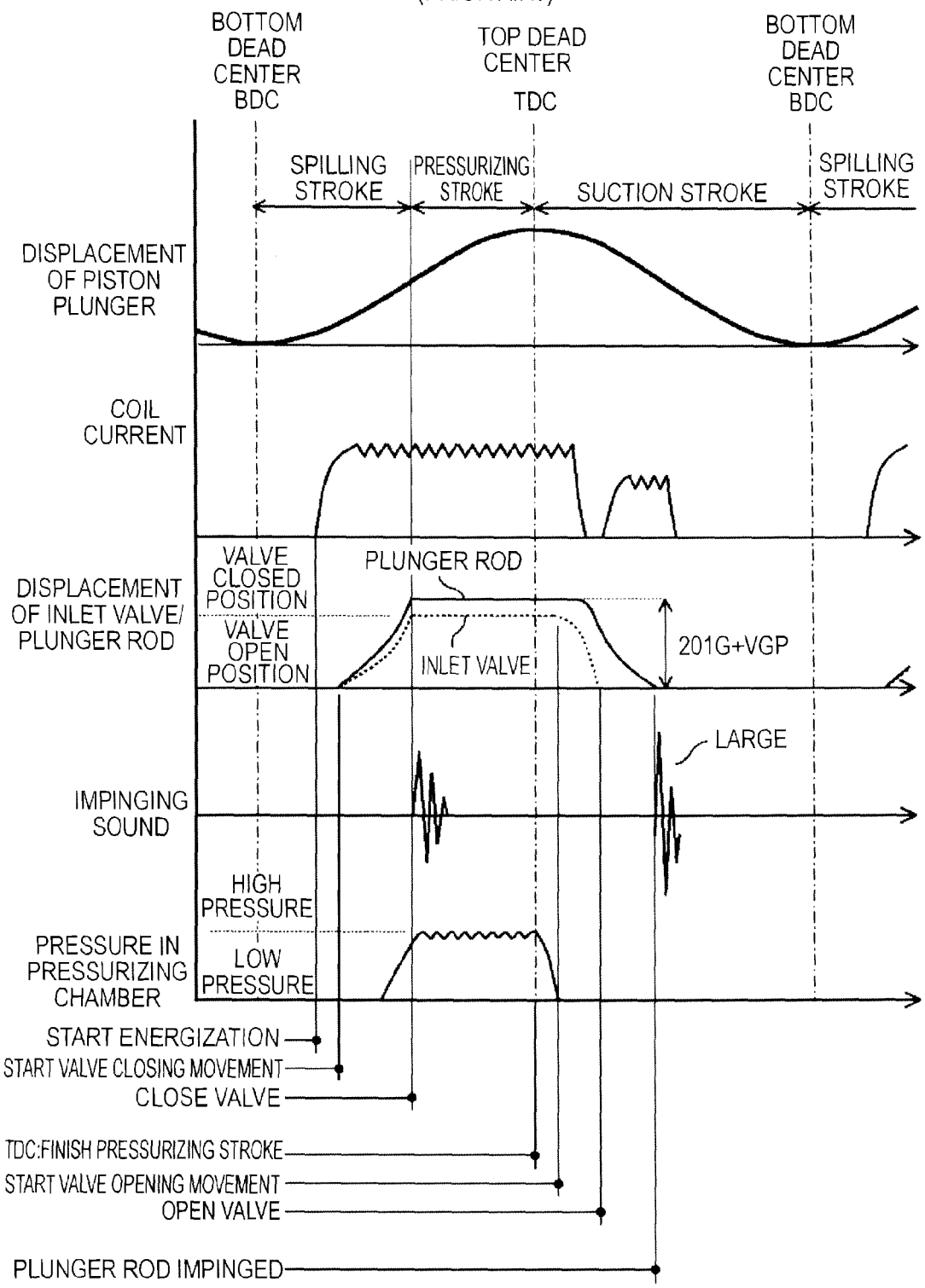
FIG. 6 is a view for explaining a control state of a conventional electromagnetically controlled inlet valve.

In the related art, as shown in FIG. 6, the limited current supply period is not provided so that the plunger rod 201 moves the distance 201G and the distance VGS collectively at a time. In this case, although the number of times that the impingement occurs is one, the moving distance per one movement is long and hence, a tendency that peak noises increase is observed.

In general, audibility of a man has propensity that in a state where a plurality of sounds are generated at timings close to each other, his attention is directed to the largest sound. That is, he feels larger noise when he receives the large impinging sound one time than when he receives small impinging sound twice. By dividing the moving distance of the plunger rod 201 in two thus reducing peak noises as in the case of the constitution of in this embodiment, it is possible to acquire an advantageous effect that noises which a man feels can be reduced.

Further, according to the present invention, before the 2nd current supply period starts, the plunger rod 201 moves to the position where the plunger rod 201 is engaged with the valve element 203 so that a current value becomes zero. Accordingly, an initial current can be surely set to zero before a second current is given and hence, the accuracy of the current control is enhanced.

The above-mentioned control method is particularly effective in an idling state of the vehicle where tranquility is particularly required and hence, the control method may be applied only under a specific condition such as an idling state.

Second Embodiment

Figure 7:
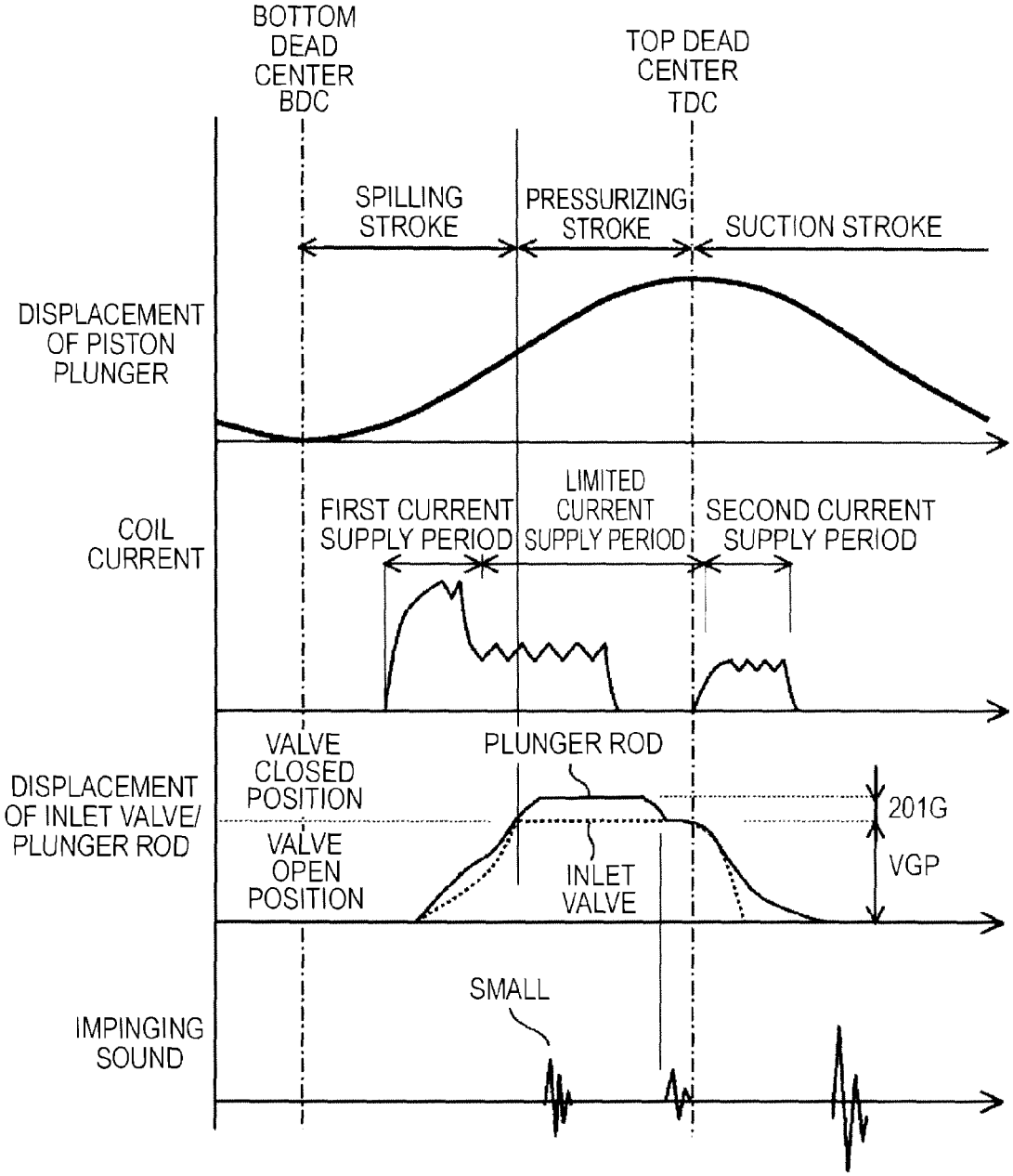
FIG. 7 is a view for explaining a control state of an electromagnetically controlled inlet valve according to a second embodiment in which the present invention is carried out.

FIG. 7 shows a second embodiment. A high pressure fuel pump of this embodiment is equal to the high pressure fuel pump of the first embodiment in constitution. In the second embodiment, a current supply period is switched to a limited current supply period while a plunger rod 201 moves in the valve closing direction. By lowering a current value to, for example, a value close to a holding current during the movement of the plunger rod 201, a magnetic attraction force is reduced so that a moving speed of the plunger rod 201 is lowered compared to a moving speed of the plunger rod 201 in the first embodiment. As a result, noises which are generated when an anchor 207 impinges on a fixed core 206 are reduced.

To consider a case where only a limited current is given without supplying a first current, a magnetic attraction force larger than a biasing force of a plunger rod biasing spring is not generated thus giving rise to a possibility that the plunger rod 201 cannot be moved. However, when the limited current is given after starting the movement of the plunger rod 201 by giving the first current, a magnetic gap GP between opposedly facing faces of the fixed core 206 and the anchor 207 is reduced and hence, a larger magnetic attraction force can be obtained with a lower current. Accordingly, by starting the movement of the plunger rod 201 in a 1st current supply period, an attraction operation can be completed during the limited current supply period.

Further, by shortening a length of the 1st current supply period, it is also possible to acquire an effect of further reducing a heating value of a solenoid and an effect of reducing power consumption.

In this embodiment, the supply of an electric current in the 2nd current supply period starts from timing of a top dead center (TDC). A solenoid has a response delay caused by inductance and hence, the rise of an electric current and the generation of a magnetic attraction force substantially take place after the top dead center. In this manner, the 2nd current supply period substantially functions after the top dead center (TDC) and hence, the limited current supply period substantially functions at the top dead center.

In this embodiment, although an electric current in the 2nd current supply period is set lower than an electric current in the limited current supply period, there is no problem in setting such an electric current. A current value in the 2nd current supply period and a length of the 2nd current supply period are suitably selected corresponding to an operation state of a pump and a response characteristic of the electromagnetically controlled inlet valve actuator 200.

Third Embodiment

Figure 8:
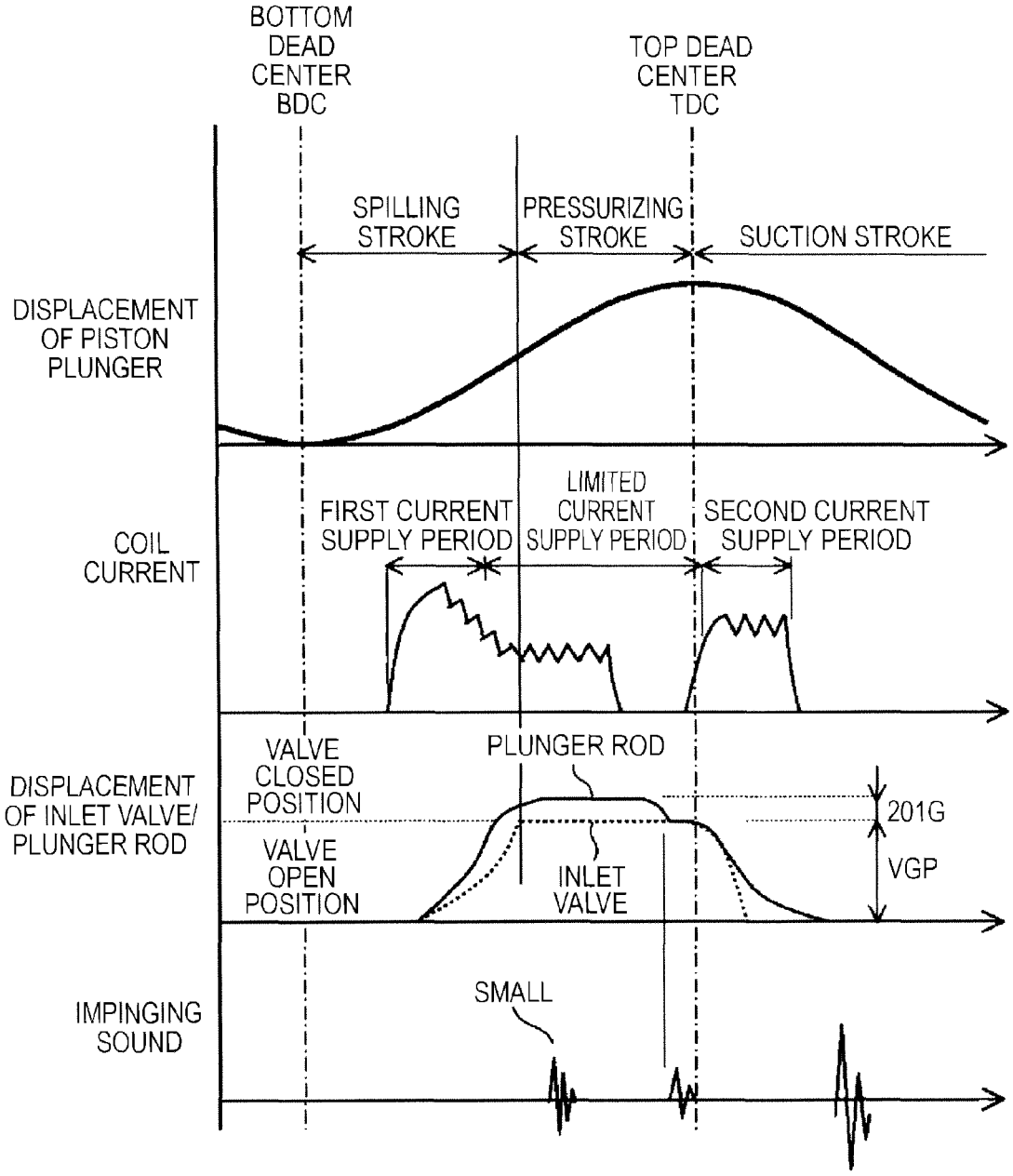
FIG. 8 is a view for explaining a control state of an electromagnetically controlled inlet valve according to a third embodiment in which the present invention is carried out.

FIG. 8 shows a third embodiment. In this embodiment, a high current is initially given in a 1st current supply period and, thereafter, the current value is lowered. Due to such an operation, the movement of a plunger rod 201 can be surely started by giving a high current initially. Further, a period during which a high current value is given can be shortened and hence, a heating value of a solenoid is not largely increased. This embodiment is advantageously applicable to a case where a current value cannot be accurately controlled or a case where it is necessary to take a large margin in an operational current.

In this embodiment, although a current value in the 1st current supply period is not a fixed value, a peak current never fails to become larger than a current value necessary for an operation of attracting a plunger rod 201 (an electric current which makes a magnetic attraction force larger than a biasing force of a plunger rod biasing spring).

In this embodiment, the supply of an electric current in the 2nd current supply period starts at timing slightly earlier than the top dead center. As described previously, when the generation of a magnetic attraction force substantially takes place after the top dead center due to a delay caused by inductance, the 2nd current supply period substantially functions after the top dead center and hence, the limited current supply period substantially functions on the top dead center.

According to the first to third embodiments, noises generated by the impingement of the plunger rod can be reduced with high accuracy by reducing the moving distance or the impingement speed of the plunger rod in the suction stroke. Further, a heating value of a solenoid and power consumption of the system can be reduced.

What is claimed is:

1. A control method of a magnetic solenoid valve for a high pressure fuel pump which comprises: a plunger rod biased by a spring; and an electromagnetic solenoid device which generates an electromagnetic force in a direction opposite to a biasing force of the spring corresponding to an electric current which flows in a solenoid, and is configured to control an operation of an inlet valve, wherein the inlet valve is provided adjacent to the plunger rod and is located on a pressurizing chamber side from an opening portion of a valve housing, and wherein the plunger rod is moved to a first position or a second position, thus respectively causing the plunger rod to be engaged with the inlet valve or causing an engagement between the plunger rod and the inlet valve to be released, the method comprising steps of: applying a first current to the solenoid, the first current generating a first electromagnetic force which is stronger than the biasing force of the spring and moves the plunger rod from the first position to the second position; subsequent to applying the first current, applying a limited current to the solenoid, the limited current having a value of zero or close to zero, and the plunger rod being kept around the second position during at least part of a compression stroke of the high pressure fuel pump; and subsequent to applying the limited current, applying a second current to the solenoid in a suction stroke of the high pressure fuel pump in which the inlet valve moves in an opening direction, the second current generating a second electromagnetic force which reduces energy of the plunger rod moving to the first position in the suction stroke, wherein a maximum value of the first current is larger than a maximum value of the second current, and wherein the second current decelerates the movement of the plunger rod after the inlet valve starts to move towards the pressurizing chamber side by a differential pressure during the suction stroke of the high pressure fuel pump and (i) before the inlet valve separated from the plunger rod strikes a stopper or (ii) before the plunger rod strikes the inlet valve.

2. The control method of a magnetic solenoid valve for a high pressure fuel pump according to claim 1, wherein a period of applying the limited current is longer than a period of applying the second current.

3. The control method of a magnetic solenoid valve for a high pressure fuel pump according to claim 1, wherein the limited current is applied to the solenoid during at least part of the compression stroke of the high pressure fuel pump.

4. The control method of a magnetic solenoid valve for a high pressure fuel pump according to claim 1, wherein the limited current and the second current are applied to the solenoid only under a specific condition.

5. A control method of a high pressure fuel pump provided with an electromagnetically controlled inlet valve, wherein the high pressure fuel pump comprises: an inlet passage for introducing fuel into a pressurizing chamber; an outlet passage for discharging the fuel from the pressurizing chamber; a pressurizing member which reciprocates in the pressurizing chamber; an inlet valve provided between the inlet passage and the pressurizing chamber; a first spring biasing the inlet valve in a valve closing direction; an outlet valve provided between the outlet passage and the pressurizing chamber; and an electromagnetic actuator for controlling an operation of the inlet valve, wherein the electromagnetic actuator comprises: a second spring; a plunger rod biased by the second spring; and an electromagnetic solenoid device which generates an electromagnetic force in a direction opposite to a biasing force of the second spring corresponding to an electric current which flows in a solenoid, and is configured to control an operation of the inlet valve, wherein the inlet valve is provided adjacent to the plunger rod and is located on a side of the pressurizing chamber from an opening portion of a valve housing, and wherein the plunger rod is moved to a first position or a second position, thus respectively causing the plunger rod to be engaged with the inlet valve or causing an engagement between the plunger rod and the inlet valve to be released, and the control method of the high pressure fuel pump comprising steps of: applying a first current to the solenoid, the first current generating a first electromagnetic force which is stronger than the biasing force of the second spring and moves the plunger rod from the first position to the second position; subsequent to applying the first current, applying a limited current to the solenoid, the limited current having a value of zero or close to zero, and the plunger rod being kept around the second position during at least part of a compression stroke of the high pressure fuel pump; and subsequent to applying the limited current, applying a second current to the solenoid in a suction stroke of the high pressure fuel pump in which the inlet valve moves in an opening direction, the second current generating a second electromagnetic force which reduces energy of the plunger rod moving to the first position in the suction stroke, wherein a maximum value of the first current is larger than a maximum value of the second current, and wherein the second current decelerates the movement of the plunger rod the inlet valve starts to move towards the pressurizing chamber side by a differential pressure during the suction stroke of the high pressure fuel pump and (i) before the inlet valve separated from the plunger rod strikes a stopper or (ii) before the plunger rod strikes the inlet valve.

6. The control method of a high pressure fuel pump according to claim 5, wherein when the pressurizing member of the pump almost reaches a top dead center, the electromagnetic actuator is controlled to the step of applying a limited current to the solenoid.

7. The control method of a high pressure fuel pump according to claim 6, wherein the first current, the limited current, and the second current are applied during one stroke of the pressurizing member.

8. The control method of a high pressure fuel pump according to claim 7, wherein the one stroke of the pressurizing member includes at least a pressurizing stroke and a suction stroke.

9. The control method of a high pressure fuel pump according to claim 5, wherein the step of applying a limited current to the solenoid comprises steps of:

holding the plunger rod at the second position; and subsequently, applying a zero current to the solenoid.

10. The control method of a high pressure fuel pump according to claim 9, wherein when the pressurizing member of the pump almost reaches a top dead center, the electromagnetic actuator is controlled to the step of applying a zero current to the solenoid, and the electromagnetically controlled inlet valve is held at a position where the electromagnetically controlled inlet valve is closed due to a pressurized fuel pressure which acts in the valve closing direction against the biasing force of the spring.

11. A control device for controlling the electromagnetic actuator described in claim 5, the control device comprising:

a microcomputer;

a driver circuit configured to allow conduction and interruption of an electric current which flows in the electromagnetic solenoid of the electromagnetic actuator based on an output from the microcomputer, wherein the microcomputer is configured to receive an operation state of a device to be controlled which is controlled by the electromagnetic actuator as an input, and output a start timing command and a finish timing command for the step of applying a first current to the solenoid, the step of applying a limited current to the solenoid, and the step of applying a second current to the solenoid corresponding to the operation state, and the driver circuit is configured to allow conduction or interruption of an electric current which flows in the electromagnetic solenoid of the electromagnetic actuator corresponding to an output of the microcomputer.

12. The control device according to claim 11, wherein the limited current is applied to the solenoid during at least part of the compression stroke of the high pressure fuel pump.

13. The control device according to claim 11, wherein the limited current and the second current are applied to the solenoid only under a specific condition.

14. A fuel discharge amount control device of a high pressure fuel pump which controls the fuel discharge amount of the high pressure fuel pump by controlling an open/close state of an inlet valve of the high pressure fuel pump of an internal combustion engine by an electromagnetic actuator described in claim 5, wherein the fuel discharge amount control device of the high pressure fuel pump comprises:

a microcomputer configured to receive an operation state of an internal combustion engine as an input, and output a start timing command and a finish timing command for the step of applying a first current to the solenoid, the step of applying a limited current to the solenoid, and the step of applying a second current to the solenoid corresponding to the operation state of the internal combustion engine, and a driver circuit configured to allow conduction or interruption of an electric current which flows in the electromagnetic solenoid of the electromagnetic actuator corresponding to an output of the microcomputer, and wherein the microcomputer is configured to output a command for applying a first current to the solenoid in a zone where a plunger of the high-pressure fuel pump moves toward a top dead center from a bottom dead center, output a command for applying a limited current to the solenoid after the inlet valve is closed and before discharge start timing of the high pressure fuel pump, and output a command for applying a second current to the solenoid after the plunger of the high pressure fuel pump changes the movement thereof toward the bottom dead center from the top dead center.

15. A control method of an electromagnetically controlled inlet valve of a high pressure fuel pump which controls an open/close state of an inlet valve of the high pressure fuel pump of an internal combustion engine by an electromagnetic actuator described in claim 5, wherein in a zone where a plunger of the high pressure fuel pump moves toward a top dead center from a bottom dead center, the inlet valve is closed by controlling the electromagnetic solenoid of the electromagnetic actuator with the step of applying a first current to the solenoid, and after the inlet valve is closed, the inlet valve is controlled to a valve opening preparation state by controlling the electromagnetic solenoid of the electromagnetic actuator with the step of applying a limited current to the solenoid, and after the plunger of the high pressure fuel pump changes the movement thereof toward the bottom dead center from the top dead center, energy which opens the electromagnetically controlled inlet valve is reduced by controlling the electromagnetic solenoid of the electromagnetic actuator with the step of applying a second current to the solenoid.

16. The control method of a high pressure fuel pump according to claim 5, wherein a period of applying the limited current is longer than a period of applying the second current.

17. The control method of a high pressure fuel pump according to claim 5, wherein the limited current is applied to the solenoid during at least part of the compression stroke of the high pressure fuel pump.

18. The control method of a high pressure fuel pump according to claim 5, wherein the limited current and the second current are applied to the solenoid only under a specific condition.

* * * * *